US005699654A

United States Patent [19]

van den Akker et al.

[11] Patent Number: 5,699,654

[45] Date of Patent: Dec. 23, 1997

[54] CAPPING APPARATUS

[75] Inventors: Richard Henry van den Akker; Nigel Baverstock; Roy Thomas Gibbs, all of Dorset, Great Britain

[73] Assignee: Carnaudmetalbox (Holdings) USA Inc., Wilmington, Del.

[21] Appl. No.: 610,153

[22] Filed: Feb. 28, 1996

[30] Foreign Application Priority Data

Mar. 9, 1995 [GB] United Kingdom ..... 9504778

[51] Int. Cl.[6] ..... B65B 51/10

[52] U.S. Cl. ..... 53/478; 53/314; 53/329.3

[58] Field of Search ..... 53/314, 315, 316, 53/329.2, 329.3, 478, 487; 156/82, 86, 497

[56] References Cited

U.S. PATENT DOCUMENTS

| | | | |
|---|---|---|---|
| 3,364,653 | 1/1968 | Wyard . | |
| 3,800,501 | 4/1974 | Raatz et al. | 53/315 |
| 3,874,147 | 4/1975 | Zetterberg | 53/315 |
| 3,908,341 | 9/1975 | Conti | 53/314 |
| 4,604,853 | 8/1986 | Albrecht et al. | 53/487 |
| 4,719,740 | 1/1988 | Gach | 53/478 |
| 4,835,943 | 6/1989 | Mueller | 53/316 |
| 4,922,684 | 5/1990 | Nelson | 53/314 |
| 5,321,934 | 6/1994 | Bech | 53/329.2 |
| 5,426,912 | 6/1995 | Hall et al. | 53/315 |

FOREIGN PATENT DOCUMENTS

| | | | |
|---|---|---|---|
| 0463819 | 3/1950 | Canada | 53/315 |
| 0018461 | 10/1979 | European Pat. Off. . | |
| 0014173 | 1/1980 | European Pat. Off. . | |
| 1408535 | 2/1972 | United Kingdom . | |
| 2228729 | 1/1990 | United Kingdom . | |
| WO94/18018 | 2/1994 | WIPO . | |

OTHER PUBLICATIONS

Search Report dated May 13, 1994.
Search Report dated Sep. 21, 1994.

*Primary Examiner*—John Sipos
*Assistant Examiner*—Ed Tolan
*Attorney, Agent, or Firm*—Diller, Ramik & Wight, PC

[57] ABSTRACT

A capping apparatus including a cap chute which is particularly suitable for applying a press-on twist-off cap having a tamper-evident ring to a container such as a glass jar. The cap chute has a guide extension and profiled components which control the cap so that it is maintained in the correct orientation within both the capping apparatus and during collection by the container.

18 Claims, 3 Drawing Sheets

CAPPING APPARATUS

BACKGROUND OF THE INVENTION

This invention relates to a capping apparatus and a method of capping. In particular, it relates to an apparatus for applying caps, such as press-on, twist-off caps (PT-PLUS or PT+ (trade marks), having a tamper evident ring to containers such as glass jars. Generally, such a capping apparatus includes a cap chute fitted above and at an angle to a horizontal conveyor, along which containers pass during the capping process.

PT plus caps and PT (trade mark) caps without tamper evident rings, are generally applied to glass jars by a cap chute in which a series of caps pass down a delivery portion of the cap chute to a cap pick-up point, where each cap is collected by a respective jar. The jars pass along a horizontal conveyor which forms part of the capping apparatus beneath the cap chute at a speed of 200 to 800 caps per minute, so that it is particularly important that a cap is immediately available for collection and that the cap is in the correct position for mating with the top of the container or jar.

PT+ caps suffer from a number of problems which differ from those found with PT closures, since the presence of a tamper evident ring aggravates an already difficult capping procedure and it is therefore not possible to use existing cap chutes.

During the capping operation, the polypropylene tamper evident ring is preheated by high pressure steam, so that the ring becomes elastically pliable and is able to be forced down and expanded over the mouth of a rigid container. The soft polypropylene can thus be deformed by the container if the ring does not engage the container correctly.

In particular, if the cap does not mate correctly with the container mouth, the cap may be tilted over the leading edge of the container. This tilting may be corrected by a "shoe" device which also forms part of the capper and which applies a load to the top of the cap/jar as it emerges from the capper. The shoe forces the cap back into the horizontal position but, as this is done, the soft tamper, evident ring "crumples" and in extreme cases may become folded back onto itself and folded between the inside of the cap itself and the outer edge of the jar.

In another common situation, a cap may become stuck or obstructed in the cap chute in some way, so that there is a delay in the cap reaching the correct position for collection by a container such as a glass jar. If a jar arrives before the cap, then the jar will not collect a cap as it passes towards the end of the cap chute. In this situation, the trailing edge of the jar may engage with the front of a cap, so that the rim of the jar pushes into the tamper evident ring. Since the ring is soft, the rim of the jar deforms the ring and may become embedded in the ring and pull the cap out of the cap chute. As a result, the next ring is also in an incorrect position and the situation may perpetuate itself with a series of rings each overlapping two successive containers when the containers are close to each other. This is known as an "avalanche" situation.

SUMMARY OF THE INVENTION

According to the present invention, there is provided a capping apparatus for a cap having a tamper evident ring connected to a hem at the base of the cap, the apparatus including:

a chute having a delivery part of fixed width and/or height with an outlet; guide means extending from the outlet for supporting the hem of the cap whilst enabling the ring to extend within the guide means, and for controlling delivery of the cap to a container; and means for holding the cap against the guide means; whereby the cap is maintained in correct orientation within the capping apparatus and during collection by the container.

Preferably, the apparatus further includes at least one stop for preventing a cap from falling out of the cap chute outlet. Each stop is preferably taller than in prior art cappers, so that it is possible for the leading cap to rise upwards before it passes over the top of the stop(s). The ability to rise up on the stops is useful if the "avalanche" situation described above arises, in which the rim of a container becomes embedded in part of the tamper evident ring on a PT+ cap, ie misaligned. If the cap can rise up the stops, the cap can free itself from the container rim and will then be forced back down onto the delivery part of the chute by holding means. In addition, the tamper evident ring on the PT+ cap causes the cap to sit higher on the chute outlet so that higher stops are required than for a PT cap.

In known cap chutes, the leading cap in a series is engaged by stops just ahead of its transverse diameter which prevent the cap from falling out of the chute. However, with the weight of a full chute of caps behind, there is always the possibility of PT caps riding up over one of the side stops and being lost onto the conveyor below. This possibility is exacerbated with PT+ caps since these have a well-defined annular protrusion to clinch in the tamper evident ring. The protrusion on the cap behind the leading cap can press down on that of the leading cap and hence encourage the front of the leading cap to move upwards against its restraint and release itself from the cap chute. The extra height given to the PT+ cap by the tamper evident ring, can also cause the cap to lift over one of the stops and be forced out of the chute by the weight of further caps behind the leading caps so that a cascade of caps may then fall onto the containers on the conveyor below. The provision of the extended guide means with raised stops, together with the holding means of the present invention, however, controls the leading cap so that premature lifting over the stops is substantially eliminated.

Capping processes are high speed operations, generally applying caps at a rate of up to 800 caps/min. It is therefore critical that no cascade of caps occurs, since the capping process would have to be halted in order to clear the caps from the container conveyor. In conventional PT cappers, the dimensions of the chute itself are therefore carefully controlled. The sides of the chute delivery part are adjusted to a width marginally wider than the width of the caps and a plate or block is lowered to limit the head space over the caps in the chute. A minimum clearance is thus allowed in conventional chutes which will still allow clear passage of the caps. The dimensions must not allow lateral movement or undue twisting of the caps in the chute but must not be reduced to such an extent that the caps stick within the chute delivery part itself. In the present invention, however, such tight tolerances of the chute are not required, since the extended guide means, stops and holding means eliminate the need for control within the chute itself.

A further feature of know PT cappers is a hold-down and a slide block. The hold-down is spring-loaded and is intended to press down on the cap so as to prevent it from inadvertently twisting over the stops and out of the chute. The hold-down of known PT cappers is only partially successful in this since it only extends over a central portion of the cap, so that pivoting about the hold-down is still possible. In the present apparatus, the stops are usually extended upwardly to prevent the cap from falling out of the chute and the hold down is designed to prevent pivoting over the stops as described below.

The slide block takes over from the hold down as a container engages with the leading cap and starts to lift it over the stops. The slide block is also spring-loaded and presses down on the cap and jar so that the cap is held in the correct position on the jar. Again, however, in the prior art, the slide block only extends over a central portion of the cap, so that pivoting is possible.

According to the present invention, the holding means may typically comprise a hold-down for holding the cap onto the container as it collects the cap and lifts the cap over the stop or stops. The hold-down preferably extends laterally across substantially the whole of the cap, so that pivoting of the cap is prevented.

Usually, the holding means may further comprise means for biasing the cap into mating engagement with the container mouth. The biasing means may also act as a further guide, such as a slide block, so that the cap slides between the slide block and the guide means until it is generally substantially parallel with the container mouth. The biasing means preferably extends laterally across substantially the whole width of the cap so that control of the cap is still carefully controlled once the cap passes beyond the hold-down and support section.

The guide means may include the stop or stops and may comprise a support section and one or more guide rails. Generally, the cap rests on a pair of supports and against a pair of stops, one on each side of the cap which prevent the cap from falling out of the cap chute. Once a container lifts the cap over the stops, the cap rests on a pair of guide rails and is biased against the rails by the slide block.

The capping apparatus according to the present invention thus maintains control of the cap right up to the point when it is seated correctly over the container mouth. Such control is particularly valuable when used with PT+ caps, where a concentric alignment of the cap and tamper evident ring on a container is required as the slide block biases the cap onto the jar.

The pair of guide rails in the present invention support a hem at the base of the cap. Typically, the cap may be a PT+ cap, in which case the cap has a more pronounced hem than that of a PT cap and the guide rails may be profiled to support the hem at the base of the cap. A tamper evident ring which is connected to the hem may then extend inside the guide rails.

The profiling of the guide rails is particularly important to enable the cap to move from its inclined position in the cap chute to a generally horizontal position, concentric with the container. Usually, the PT+ cap rests with its tamper evident ring on the support section of the guide means and control of the cap position may also comprise shaping of individual components so that the softened ring passes within the guide rails when lifted over the stops and the biasing means does not cause any direct pressure to be transmitted to the ring which might otherwise cause the ring to be distorted.

One further reason for the control of PT+ caps being particularly important is the fact that the pronounced hem on one cap can overlap with the hem of the cap in front of it, causing the front cap to be pushed down at the back and tilted up at the front, potentially over the top of the stops and onto the conveyor below the cap chute.

Advantageously, the shaping of individual components may include scalloped-shaped stops. This shape additionally has the advantage that scuffing of the cap is avoided. Profiling of the stops may also be provided to facilitate upward and forward movement of the cap over the stops as it is collected by a container.

The hold-down may usually include wings. The provision of a winged shape prevents the cap from twisting over the stops prematurely. Generally, the slide block is also provided with wings which again prevents twisting or pivoting of the cap.

The slide block may include a scalloped back, so that the leading edge of the cap does not catch on the slide block. This is particularly important for a PT+ cap, since if a container attempts to collect the cap it can sometimes be prevented from doing so if the cap were caught on the slide block. However, the container would still engage the tamper evident ring and rip it off the cap body itself as the container is moved forward by the conveyor on which it sits.

The preferred shaping of these individual components serves to control the cap position precisely so as to ensure a clean pick-up by a container. The efficiency of such a design results in the width of the guide chute ceasing to be as critical as in capping apparati of the prior art. Thus, whereas it has previously been necessary to adjust the width of the chute very precisely so as to prevent a cascade of caps and also to avoid sticking of the caps within the chute, it has been found that the profiling of various components according to the present invention avoids the need for control of the guide chute width.

Generally, therefore, the apparatus may include a chute having a fixed width which may allow typically as much as between 2 mm and 3 mm either side of the caps because control at the end of the chute is so carefully controlled. Whilst this means a different chute for different width caps, there are usually only two dedicated chutes required—one for 51 mm caps and a second for 40 mm caps. Both dedicated chutes are simplified over prior art chutes since there is no requirement for the provision of adjusters for altering the chute width.

The chutes may also need to differ to cope with the difference in behavioural characteristics between caps of varying widths. In particular, it is noted that a 51 mm cap has a greater amount of plastic available for stretching its tamper evident ring over the mouth of a glass jar than does a 40 mm cap. The 51 mm cap is thus more flexible in its application to the jar since the ring does not need to stretch as much as a 40 mm cap in the short time available for application.

According to a further aspect of the present invention, there is provided a method of applying a cap to a container, the cap having a tamper evident ring connected to a hem at the base of the cap, the method comprising:

softening the tamper evident ring by warming the ring;

delivering of the cap to the outlet of a cap chute;

supporting the hem of the cap on guide means extending from the outlet of the cap chute whilst enabling the ring to extend within the guide means; holding the cap against the guide means;

and controlling delivery of the cap to the container by maintaining the cap substantially in alignment with the chute and guide means until collection from the guide means by the container.

A preferred embodiment of capping apparatus will now be described, by way of example only, with reference to the drawings, in which:

DESCRIPTION OF THE PREFERRED EMBODIMENTS

Figure 1:
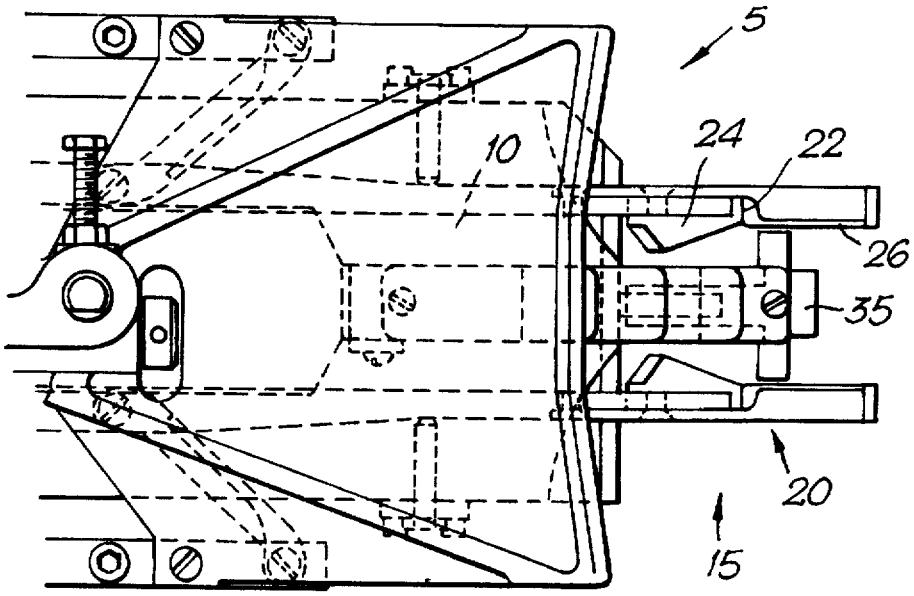
FIG. 1 is a plan view of a capping apparatus according to the present invention, with hold-down omitted.
Figure 2:
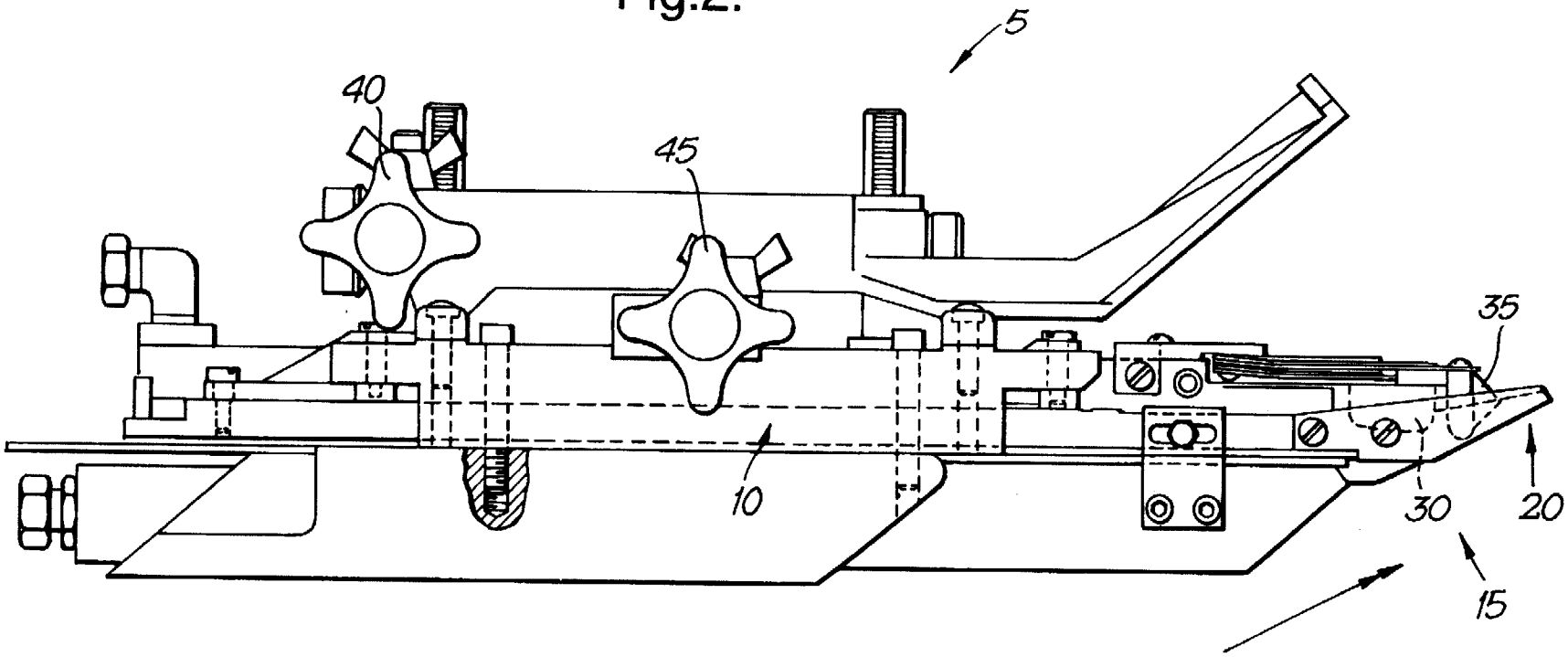
FIG. 2 is a side view of the capping apparatus of FIG. 1, with hold-down fitted.

In FIGS. 1 and 2 there is shown a capping apparatus 5 suitable for applying a series of PT+ caps to glass jars which pass below the capper in the direction indicated by the double arrow in FIG. 2. A series of caps enters the passes along a chute 10 within the apparatus to a pick-up point 15 at the opposite end of the chute. High pressure steam is passed down the chute so that a tamper evident ring fixed to a hem at the base of the PT+ cap is softened ready for passing over beading or other engagement features around the mouth of a container.

The pick-up point 15 comprises a region of the capping apparatus which is extended beyond the chute 10 by a pair of guide extensions 20. Each extension has a stop 22, a support rail 24 and a guide rail 26. Above the guide extensions are provided a winged hold down 30 (see FIG. 2) and a winged slide block 35 which are spring loaded to provide downward forces.

The apparatus further includes height adjustment components 40 and, optionally, width adjustment components 45 which provide adjustment of the chute dimensions for different sizes of cap. Usually the width adjustment components are omitted as these are not required in the present invention. It would also be possible to omit the height adjustment components 40, if the height of the chute is preset during manufacture to the height of the caps with which the chute is to be used.

The capping apparatus is generally operated at an angle of about 40° to the horizontal, so that caps descend along the chute to the pick-up point under the action of gravity. The two stops 22 prevent the leading cap from moving forward from its position on the support rails 24 pending pick-up by the next jar. This location on the support rails is assisted by the hold-down 30 which is situated over the leading cap which is on the support rails and sitting against the stops. Usually the hold-down is spaced slightly from the top of the cap so that no downward pressure is exerted on the cap whilst it is resting on its tamper evident ring at the stop position. If the cap is lifted, however, the hold-down acts directly on the cap. There is thus never any sandwiching of the cap and tamper evident ring which would exert pressure on the tamper evident ring. The PT+ cap simply rests on its tamper evident ring on the support rails, ready for collection by the next container.

The hold-down is generally bevelled from rear to front so that each cap is guided towards the outlet of the apparatus freely and easily once the cap is collected by the container.

The leading cap is thus maintained in position by the stops and hold-down but the weight of the caps behind has been known in previous PT cappers to cause the leading cap to twist over one or both of the stops, thus allowing it to fall onto the jar conveyor below the capper. This problem has been substantially eliminated by the stop height and winged hold down.

When the leading cap is picked up by a jar, it is carried beyond the stops but the hem of the cap instead of the tamper evident ring then rests on the guide rails 26. The stops are therefore profiled so that the hem of the cap passes smoothly over the stops and onto the guide rails. The tamper evident ring of the cap meanwhile passes within these guide rails. The profiling of the individual components thus avoids damage to the tamper evident ring, which is softened so that it is capable of passing over screw threads on the jar, for example.

A slide block 35 takes over from the hold-down as the cap passes along the guide rails and exerts a downward force on the cap to help maintain the cap in the correct substantially horizontal position between the slide block and the guide rails as it engages the jar. The slide block is also provided with wings in the present invention. The cap is thus still prevented from twisting by the slide block and guide rail combination, even though the cap is being carried by a jar.

Figure 3:
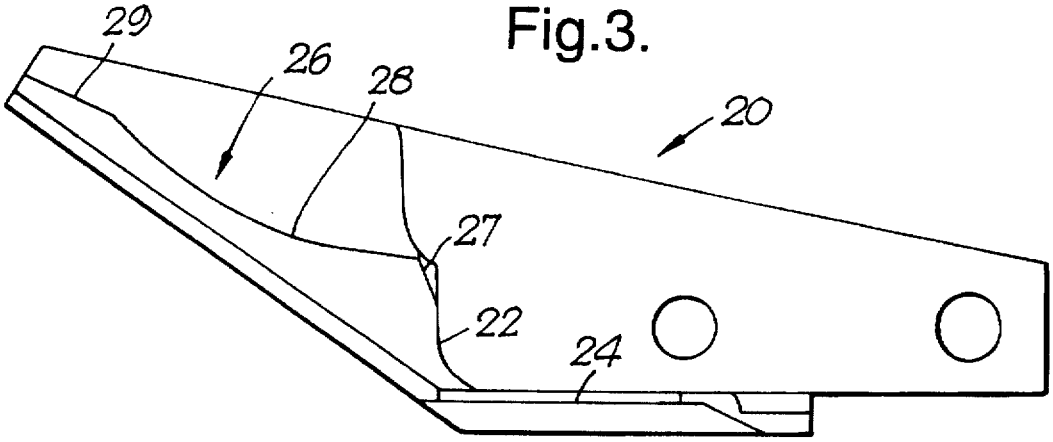
FIG. 3 is a side view of a guide extension.
Figure 4:
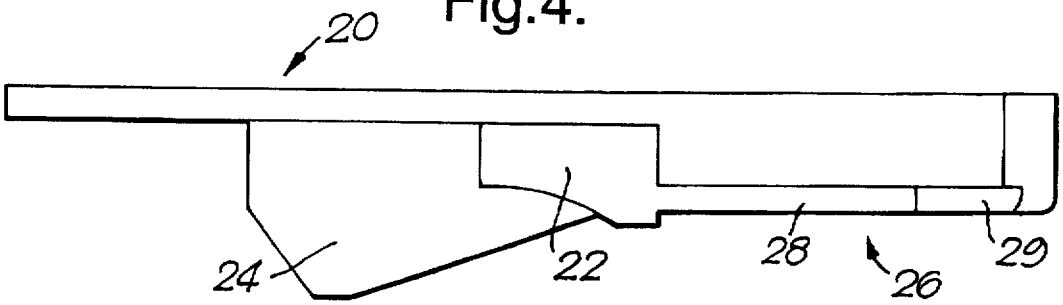
FIG. 4 is a plan view of a guide extension.

A typical guide extension 20 is shown in more detail in FIGS. 3 and 4. This aspect shows the inside of the guide extension which comprises the stop 22, support rail 24 and guide rail 26. The guide extension is bolted onto the end of the delivery part of the cap chute 10 as seen in FIGS. 1 and 2 so that the support rail 24 is in the same plane as the base of the delivery part 10. The PT+ caps thus rests on its tamper evident ring on the support rails 24 as the cap exits the delivery part 10 and is prevented from further forward motion by the stops 22.

As the cap is picked up by a jar, it lifts the cap over the stops 22 against the downward force of the hold-down until the hem of the cap rests on the guide rails 26. The guide rails are spaced further apart than the tamper ring diameter, so that only the hem rests on the guide rails.

The stops are profiled at their front edges 27 as is best seen in FIG. 3, so the cap can be smoothly transferred onto the guide rails from the support rails, with the hem of the cap moving onto the guide rails as the cap is lifted over the stops and off the support rails. Meanwhile, the tamper evident ring passes within the guide rails so that no direct pressure is exerted on it. In addition, the guide rails curve at 28 to allow the cap to be gradually transferred from its initial inclined position towards the horizontal position in which it will be forced onto the jar.

A final portion 29 of the guide rail which is parallel to the plane of the top of the jar and conveyor, ie roughly horizontal, ensures that the cap is held firmly between the slide block and this planar portion 29 as the jar is forced into the cap. Once on the guide rails, lifting of the cap is opposed firstly by the hold-down to prevent an "avalanche" of caps, then by both the hold-down and slide block and finally, on the final planar portion 29, by the slide block alone which forces the cap onto the container, both the hold-down and slide block being full width.

Figure 5:
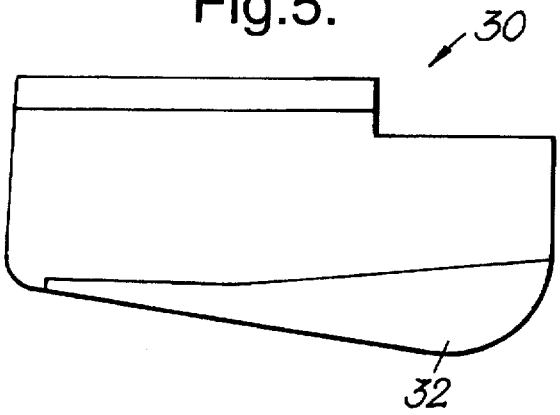
FIG. 5 is a side view of the hold-down.
Figure 6:
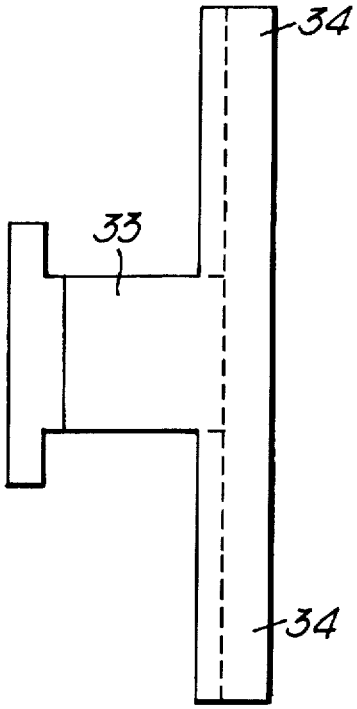
FIG. 6 is an end view of the hold-down of FIG. 5.

FIGS. 5 and 6 show the hold-down and how it is shaped so as better to control the positioning of the cap. FIG. 4 shows the profile of the hold-down which, in use, would engage a cap passing from left to right. When the cap engages the stops, the deepest portion 32 of the hold-down is just clear of the top of the cap and forward of its centre. The hold-down only contacts the cap when it is lifted up the stops.

Any tendency of the cap to lift upwards due to the weight of caps impinging on the rear of the cap is controlled by the bevelled shape of the hold-down which guides the cap back towards the correct position on the support rails behind the stops. The cap is thus not held firmly between the hold-down and support rails which might damage the tamper evident ring but unwanted movement of the cap over the stops is prevented by the hold-down if the cap is lifted at all by the weight of caps behind it in the delivery part of the cap chute, for example.

Any risk of twisting of the cap is avoided by the provision of wings 34 which give full-width control of the cap. This is in contrast to prior art hold-downs which would simply give control of a central portion of the cap, generally over the width of part 33 as seen in FIG. 6.

Figure 7:
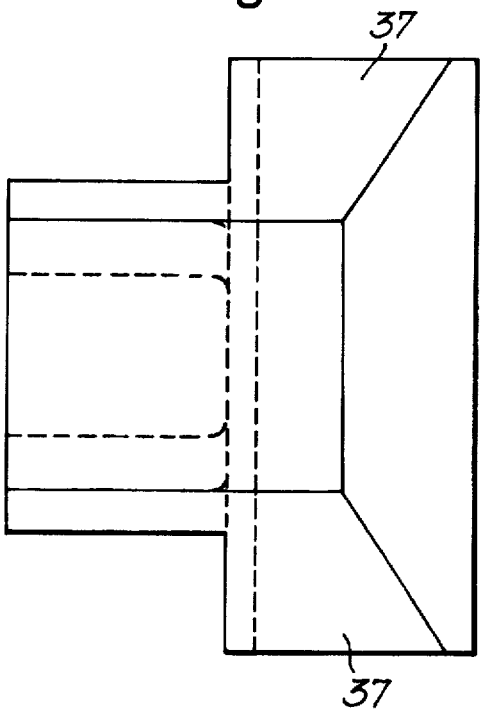
FIG. 7 is a plan view of a slide block.
Figure 8:
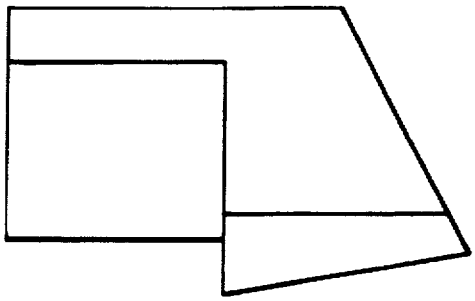
FIG. 8 is a side view of the slide block of FIG. 7.

In a similar manner to the hold-down, the slide block (see FIGS. 7 and 8) is also provided with wings 37. The winged portions are angled so as to be parallel with the planar portion of the guide rails, thus controlling the cap effectively as described above.

It can be seen that the cap position is controlled very carefully by the various elements of the extended capping apparatus whilst pick-up by a jar is taking place. In particular, the softened tamper evident ring of PT+ cap is maintained free of the guide rails as the jar is forced into the cap, so that crumpling of the ring is effectively avoided. Crumpling of the tamper evident ring is also avoided by the provision of the guide extensions, in particular the guide rails themselves, which guide the cap from the incline to the horizontal so that the cap is coaxial with the jar when it is forced down onto the jar. Any inclination of the cap would cause the tamper evident ring to be distorted.

It has surprisingly been found that the cap position is controlled so well by the elements of the present invention, that adjustment of the width of the delivery part of the cap chute 10 is no longer required. Previously, the chute dimensions have been adjusted so as to give minimum clearance for the caps as they pass along the delivery part of the chute. This prevented lateral movement or undue twisting of the caps within the delivery part itself. However, with the control of the present invention, only the adjustment of the height of the delivery part is needed and it is possible to use fixed width dedicated chutes for each of the standard sizes of PT+ caps. As noted above, it is also possible to fix the height of the cap chute by the use of a dedicated chute and so also avoid the need for height adjustment components as well as width adjustment components.

The control of the cap orientation ensures that the cap does not tilt over the mouth of the container when it is picked up which would otherwise result in the tamper evident ring being distorted and even folded back on itself when pressed down on the container by a "shoe" which loads the cap once it leaves the cap chute part of the capping apparatus. Generally when used with the present invention, the shoe will be positioned nearer to the cap chute than in prior art systems so that control is still maintained once the cap leaves the control of the slide block.

Since the delivery part of the cap chute can be a fixed width in which caps can move freely, there is no danger of caps becoming stuck in the chute itself. Thus there is no delay in the cap reaching the correct position for collection by the container with the self-perpetuating avalanche problems of caps overlapping a pair of containers when the tamper evident rings are embedded in the edge of the container mouth as described above.

It will be appreciated that the invention has been described by way of example only and that changes may be made without departing from the scope of the invention as defined by the claims.

We claim:

1. A method of applying a cap to a container, the cap having a tamper evident ring connected to a hem at the base of the cap, the method comprising:

softening the tamper evident ring by warming the ring;

delivering the cap to the outlet of a cap chute;

supporting the hem of the cap on guide means extending from the outlet of the cap chute whilst enabling the ring to extend within the guide means;

holding the cap against the guide means; and controlling delivery of the cap to the container by maintaining the cap substantially in alignment with the chute and guide means until collection from the guide means by the container.

2. A capping apparatus for a cap having a hem defining an exterior diameter and a depending tamper evident ring defining an exterior diameter less than the hem exterior diameter comprising a cap chute having an outlet, guide means for delivering each cap to an associated container, said guide means including a pair of spaced guides along which diametrically opposite chordal portions of each cap are adapted to slide; said pair of spaced guides including a pair of spaced support rail portions substantially adjacent said outlet and a pair of spaced guide rail portions substantially remote from said outlet; said support rail portions being spaced from each other a distance less than said tamper evident ring exterior diameter whereby the tamper evident ring of each cap slides along said support rail portions, and said guide rail portions being spaced from each other a distance greater than said tamper evident ring exterior diameter but less than the hem exterior diameter whereby the hem of each cap slides atop and along said guide rail portions and the tamper evident ring of each cap slides between and along said guide rail portions.

3. The capping apparatus as defined in claim 2 including stop means between each support and guide rail portion for stopping sliding movement of each cap.

4. The capping apparatus as defined in claim 2 including stop means between each support and guide rail portion for stopping sliding movement of each cap, and said stop means is defined as a smooth unbroken transition surface between associated support and guide rail portion.

5. The capping apparatus as defined in claim 2 including means for holding each cap against said guide means.

6. The capping apparatus as defined in claim 2 including first means for holding each cap against said support rail portions, and second means for holding each cap against an associated container.

7. The capping apparatus as defined in claim 2 including means for biasing each cap into mating engagement with a mouth of each associated container.

8. The capping apparatus as defined in claim 2 including stop means between said support and guide rail portions for stopping sliding movement of each cap, and each stop means is defined as a transition surface elevating upwardly from each support rail portion to the associated guide rail portion.

9. The capping apparatus as defined in claim 2 wherein said support rail portions include transversely opposing spaced edges which are in diverging relationship in the direction of cap travel.

10. The capping apparatus as defined in claim 2 including stop means between said support and guide rail portions for stopping sliding movement of each cap, each stop means is defined as a transition surface elevating upwardly from each support rail portion to the associated guide rail portion, and a profiled edge portion defining a juncture between each transition surface and its associated guide rail portion.

11. The capping apparatus as defined in claim 4 including means for holding each cap against said guide means.

12. The capping apparatus as defined in claim 4 including first means for holding each cap against said support rail portions, and second means for holding each cap against an associated container.

13. The capping apparatus as defined in claim 4 including means for biasing each cap into mating engagement with a mouth of each associated container.

14. The capping apparatus as defined in claim 4 wherein said support rail portions include transversely opposing spaced edges which are in diverging relationship in the direction of cap travel.

15. The capping apparatus as defined in claim 8 including means for holding each cap against said guide means.

16. The capping apparatus as defined in claim 8 including first means for holding each cap against said support rail portions, and second means for holding each cap against an associated container.

17. The capping apparatus as defined in claim 8 including means for biasing each cap into mating engagement with a mouth of each associated container.

18. The capping apparatus as defined in claim 8 wherein said support rail portions include transversely opposing spaced edges which are in diverging relationship in the direction of cap travel.

* * * * *